United States Patent [19]

Schrecker et al.

[11] 4,145,801

[45] Mar. 27, 1979

[54] METHOD OF FORMING AN INTEGRAL RIVET FOR AN EASY OPEN CAN END

[75] Inventors: H. Dale Schrecker, Leechburg; Richard C. Speer, Lower Burrell, both of Pa.

[73] Assignee: Aluminum Company of America, Pittsburgh, Pa.

[21] Appl. No.: 876,890

[22] Filed: Feb. 13, 1978

[51] Int. Cl.[2] ..... B21D 39/00; B23P 11/02

[52] U.S. Cl. ..... 29/509; 29/522 A; 113/121 C

[58] Field of Search ..... 29/509, 522; 113/121 C

[56] References Cited

U.S. PATENT DOCUMENTS

| | | | |
|---|---|---|---|
| 3,191,564 | 6/1965 | Fraze | 113/121 C |
| 3,346,948 | 10/1967 | Henning et al. | 29/509 |
| 3,361,102 | 1/1968 | Rouse | 113/121 C |
| 3,411,470 | 11/1968 | Fraze | 113/121 C X |
| 3,440,713 | 4/1969 | Henchert | 29/509 |
| 3,602,980 | 9/1971 | Heffner | 113/121 C X |
| 3,638,597 | 2/1972 | Brown | 113/121 C X |
| 3,750,606 | 8/1973 | Schultz | 113/121 C X |

FOREIGN PATENT DOCUMENTS

| | | | |
|---|---|---|---|
| 1487267 | 9/1977 | United Kingdom | 29/509 |

*Primary Examiner*—Charlie T. Moon

*Attorney, Agent, or Firm*—Patrick J. Viccaro; William J. O'Rourke, Jr.

[57] ABSTRACT

An improved method of deforming an integral hollow rivet from an outwardly projecting bubble portion formed in sheet material is provided comprising the step of deforming a generally circular portion of the sheet material within the area of the bubble portion inwardly of the general plane of the sheet material, during the step of deforming the bubble portion into a hollow rivet.

7 Claims, 7 Drawing Figures

METHOD OF FORMING AN INTEGRAL RIVET FOR AN EASY OPEN CAN END

BACKGROUND OF THE INVENTION

1. Field of the Invention

The present invention relates to an improvement in the method of forming an integral hollow rivet in deformable sheet material wherein the rivet is used to attach a tab thereto. More particularly, this invention pertains to an improvement in forming an integrally riveted pull tab on a can end whereby the panel remains rigid because excess metal is not pushed into the central panel, and, therefore, no portion of the panel tends to protrude upwardly of the can end.

2. Description of the Prior Art

The first operation of forming an integral rivet for an easy open can end or the like consists of forming an outwardly projecting bubble in the central portion of a can end. When reforming this bubble into a hollow rivet or button in a second operation, a portion of the sheet metal in the bubble tends to flow into the uncompressed area of the central portion of the can end. Any disposition of additional sheet material into the uncompressed panel area causes the central portion to be more susceptible to bulging and other surface deformities in response to internal and external pressures against the can end. Although bulging may occur regardless of the thickness of the metal in the can end, such end panel deformities are particularly acute when thin gauge metal is used for the can end, such as aluminum alloy 5352 of H19 temper having a gauge of about 0.012 inch or less. Localized bulging of the central portion around the formed rivet may cause the tab attached thereto to protrude upwardly of the general plane of the central portion on occasion. It is known that an upwardly protruded tap displaced in response to bulging of the central portion often retains such displaced configuration even after the bulge has receded.

Bulges in a can end and upwardly protruding pull tabs on easy opening can ends have numerous disadvantages. First, the protruding tab is more susceptible to premature opening of the can, which may easily result during handling and transportation of such cans. Also, an upwardly protruding bulge in the central portion may be excessive enough to cause can stacking difficulties. Finally, bulges in the can end or displaced tabs present an unsightly appearance detracting from the desired commercial impression of a container.

It has been taught in the prior art that the area of the central portion about the hollow rivet or button may be coined. Such coining operation causes the excess metal to flow outwardly of the button into a localized area of the central portion where bulging may occur. Attempts to prevent such outward metal flow include clamping the area of the central portion between a set of dies, but such compression adds a cost to the forming operation and does not insure that the metal does not flow beyond the compression dies and may, therefore, still result in bulging of that area of the central portion.

The prior art also teaches the simultaneous formation of an annular groove at the base of the outwardly projecting bubble as the bubble itself is formed in the first operation. Such annular groove, which is formed in metal that lies outside the dimension of the bubble, facilitates the lifting of the pull tab. Such groove does not prevent bulging in the area of the central portion outside the finally formed rivet.

Accordingly, an improved method of forming an integral hollow rivet in deformable sheet material is desired to prevent unwanted surface deformities in the sheet material about the rivet.

SUMMARY OF THE INVENTION

The invention may be summarized as providing a new and improved method of forming an integral hollow rivet in deformable sheet material for attaching a tab thereto, comprising the steps of forming a portion of the sheet material into a bubble disposed outwardly of the general plane of sheet, deforming the bubble portion into a hollow rivet, disposing a tab onto the deformable sheet with the rivet extending through and nesting in an aperture provided in the tab and deforming the outwardly facing surface of the rivet toward the general plane of the deformable sheet material, such that a portion of the outwardly facing surface of the rivet is shaped into permanent overlapping engagement with a portion of the underlying tab. The improvement of the present invention comprises deforming a generally circular portion of the sheet material within the area of the bubble portion into an annular groove below the general plane of the sheet material, during deformation of the bubble portion into a hollow rivet, and retaining such annular groove after the rivet is shaped into permanent overlapping engagement with the underlying tab.

Among the advantages of the subject invention is the provision of a method for forming an integral hollow rivet in deformable sheet material wherein the can end is free from bulges and other unwanted surface deformities.

Another advantage of the present invention is the provision of a method for reforming a first operation bubble in an end panel into a second operation hollow rivet wherein excess metal in the bubble is not able to flow into the end panel about the rivet.

An objective of this invention is to provide a method of reforming a first operation bubble in a can end into a second operation hollow rivet or button while retaining transverse strength and rigidity in the end panel about the rivet.

Another objective of the present invention is to provide an improved method of forming a hollow rivet in a sheet metal can end of relatively thin gauge without decreasing the metal's resistance to bulge or deflect in a direction from the general plane of the central portion of the can end.

These and other objectives and advantages of this invention will be more thoroughly comprehended and appreciated with reference to the following description and the accompanying drawings.

DESCRIPTION OF THE PREFERRED EMBODIMENTS

Figure 1:
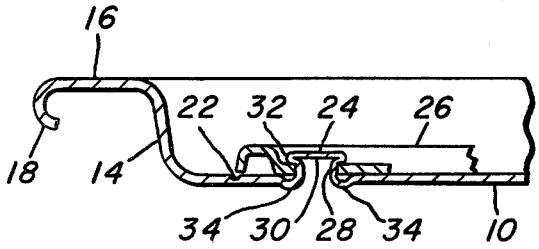
FIG. 1 is an enlarged, fragmentary, cross-sectional view of an easy open can end having a hollow rivet construction formed in the central portion in accordance with the present invention.
Figure 2:
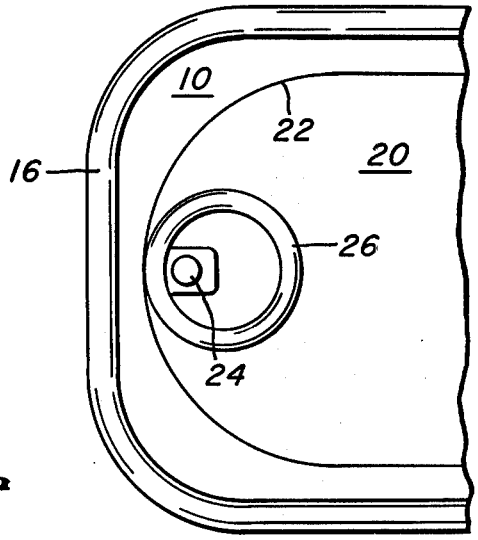
FIG. 2 is a top plan view of the easy open can end shown in FIG. 1.

Referring particularly to the drawings, FIGS. 1 and 2 illustrate a typical sheet metal can end which includes a substantially planar central portion 10 and an integral chuckwall 14 extending to a peripheral flange 16 with a curled edge portion 18 at the end thereof. The peripheral flange 16 is used for attaching the can end to a cylindrical sidewall of a container (not shown).

A tear strip 20, defined by score line 22, is provided in the can end. An integral rivet 24 is provided in the tear strip 20. A tab 26, such as the illustrated ring type, having an aperture therein, is attached to the can end by the rivet 24. The rivet 24 of the present invention has a generally cylindrical peripheral wall 28 and an end wall 30. The surfaces of the tab 26 defining the aperture nest around the outer surface of the peripheral wall 28. A beaded portion 32 of the rivet 24 overlies at least a portion of the underlying tab 26. An embossed area 34 is provided below the plane of the central portion 10 and the tear strip 20 around the rivet 24.

As used herein, the terms "inwardly" and "outwardly" refer to the interior and exterior areas of a can end with respect to the interior and exterior portions of a container to which the can end is seamed in the conventional manner.

Figure 3:
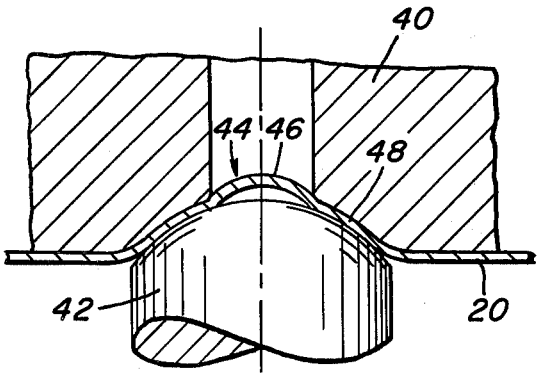
FIG. 3. PRIOR ART
FIG. 3 is a cross-sectional view through a punch and die used as a first forming operation to form a bubble in the central portion of the can end shown in FIGS. 1 and 2.
Figure 4:
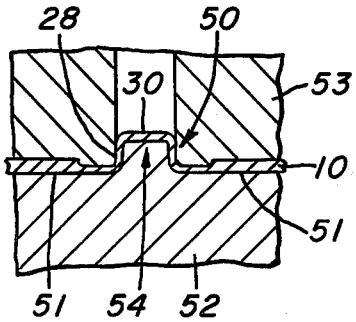
FIG. 4. PRIOR ART
FIG. 4 is a cross-sectional view through a punch and die used as a second forming operation to reform the bubble shown in FIG. 3 into a hollow rivet in accordance with conventional practice.
Figure 5:
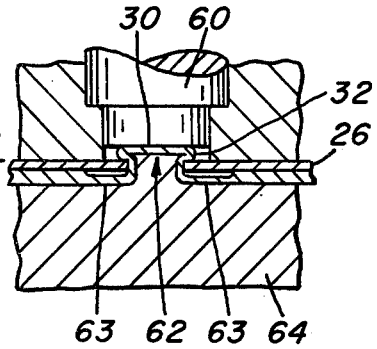
FIG. 5. PRIOR ART
FIG. 5 is a cross-sectional view through a punch and die used to stake the rivet shown in FIG. 4 over a tab placed thereon.

FIGS. 3 to 5 illustrate sequentially a conventional method of forming an integral hollow rivet in deformable sheet material for securing a tab thereto. In the first operation as shown in FIG. 3 a central portion of the tear strip 20 is domed outwardly with respect to the general plane of the tear strip 20 by moving the upper die 40 toward the lower punch 42 with the can end positioned therebetween. The resulting bubble 44 is stretched or compression formed in the flat sheet material. Typically the sheet material is aluminum alloy 5352 in H19 temper having a gauge of less than 0.012 inch. The resulting bubble 44 has a thinned central wall 46 and a sloping wall 48 progressively decreasing in thickness as it extends toward the general plane of the tear strip 20. This progressive thinning of the metal wall is caused by extrusion of the metal to elongate the wall and form the bubble. Typically, the bubble 44 has a diameter of approximately 0.250 to 0.300 inches and a height of approximately 0.100 inches, as measured from the lower surface of the tear strip 20 to the outer surface of the bubble 44.

FIG. 4 illustrates the second operation of the conventional rivet forming method wherein the bubble portion 44 is deformed into a hollow rivet 50. The upper surface 51 of lower punch 52 supports the central portion of the can end which is centered between the tools 52 and 53 such that a generally cylindrical projection 54 extends upwardly of the generally planar top surface 51 of the lower punch 52 with the projections 54 centrally located inside the outwardly domed bubble portion 44 of the can end. A hollow, upper cylindrical die 53 is moved toward the lower punch 52 to deform the metal defining the bubble portion 44 in the manner illustrated to form a hollow rivet 50. Such movement deforms the sloping wall 48 of the bubble into a generally cylindrical peripheral wall 28, and the thinned central wall 46 into an end wall 30. The end wall 30 may be generally planar or slightly radiused outwardly, and such configuration will usually conform to the configuration of the top surface of the projection 54. If desired, an area of metal in the tear strip 20 around the rivet 50 may be coined, as shown in FIG. 4. Typically, the formed hollow rivet 50 has a height of approximately 0.80 inches and a diameter of approximately 0.125 inches.

After the hollow rivet 50 has been formed, a tab 26 is disposed over the rivet 50 such that the end wall 30 of the rivet 50 extends through an aperture in the tab 26, and the peripheral wall 28 nests within the surfaces of the tab defining the aperture. After the tab 26 is so disposed, the rivet 50 is staked by moving a punch 60, shown in FIG. 5, against the end wall 30 which is supported in the opposite direction by an outwardly projecting anvil 62 provided on a bottom die 64. The generally planar undersurface of the tear strip 20 around the rivet is also supported by the generally planar top surface 63 of the bottom die 64. Deforming and extruding the end wall 30 of the rivet 50 toward the tab 26 and the tear strip 20 causes a portion of the end wall 30 to be formed into a round, thinned bead 32 disposed in permanent overlapping engagement with a portion of the underlying tab 26. The height of the finally staked rivet 28 is approximately 0.50 inches. It will be understood by those skilled in the art that such height depends upon the particular gauge of the material used.

There is an inherent disadvantage in forming the integral rivet by the above-described conventional method which is overcome by the method of the present invention. As a result of the second forming operation illustrated in FIG. 4, excess metal flows into the tear strip 20. The presence of such excess metal causes the tear strip 20 to lose its rigidity in and around the affected localized areas. Such phenomenon results in creating bulges in the plane of the tear strip 20 or renders the tear strip 20 more susceptible to bulging when subjected to relatively low internal pressure after the can end is seamed to a filled food container. Bulges and other surface deformities are minimized by the present invention which provides an improvement in the second forming operation as discussed in detail below.

Figure 6:
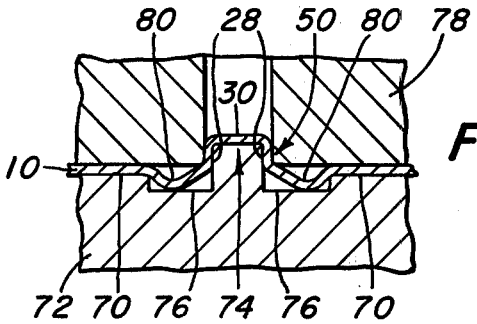
FIG. 6 is a cross-sectional view through a punch and die used as a second forming operation to reform the bubble shown in FIG. 3 into a hollow rivet in accordance with the present invention.
Figure 7:
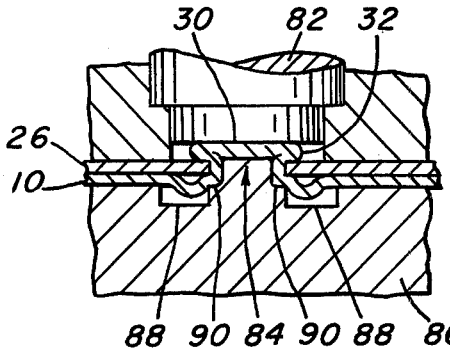
FIG. 7 is a cross-sectional view through a punch and die used to stake the rivet shown in FIG. 6 over a tab placed thereon.

FIGS. 3, 6 and 7 illustrate sequentially an improved method of forming an integral hollow rivet in deformable sheet material for securing a tab thereto. The first operation of forming a bubble portion 44, as shown in FIG. 3, is identical to the conventional method described above.

FIG. 6 illustrates the second operation of the improved rivet forming method in which the bubble portion 44 is deformed into a hollow rivet 50. The generally planar upper surface 70 of a lower punch 72 supports the tear strip 20 in the central portion of the can end, such that a generally cylindrical projection 74 on the lower punch 72 is centrally located inside the dimensions of the bubble portion 44. A recess 76 is provided around the base of the projection 74 below the general plane of the upper planar surface 70 of the lower punch 72. Preferably, the outside diameter of the recess 76 does not exceed the diameter of the bubble portion 44 formed in the first operation. The upper die 78 is hollow and cylindrical, similar to the die 53 illustrated in FIG. 4. The die 78 has a cylindrical opening 79 of sufficient diameter, such as 0.125 inch, to receive the cylindrical projection 74 on the lower punch 72 and an annular layer of the sheet metal of the bubble portion 44.

To deform the metal defining the bubble portion 44 in the manner illustrated in FIG. 6, the die 78 is moved toward the lower punch 72. The sloping wall 48 of the bubble portion 44 is deformed inwardly to begin formation of the peripheral wall 28 of the rivet 50. As the tools 72 and 78 are closed, as illustrated in FIG. 6, the bubble 44 has been converted into a rivet 50 having a peripheral wall 28 and an end wall 30. The end wall 30 may be generally planar or slightly radiused outwardly.

As the metal in the bubble portion 44 is formed into the rivet 50, excess metal is driven outwardly of the rivet 50. By providing a recess 76 in the lower punch 72, a generally circular portion of the sheet metal of the bubble portion 44 is deformed inwardly of the general plane of the central portion to form an inwardly embossed ring 80 about the base of the rivet 50. Such deforming method substantially reduces the metal compression that would otherwise occur in the panel area adjacent the bubble portion 44. Therefore, the metal is able to free flow into the recess 76 forming an annular groove 80 or embossed ring, as the rivet 50 is formed, rather than be forced into the area of the tear strip 20. The boundaries of the annular groove 80 are within the area originally formed into the bubble portion 44.

After the hollow rivet 50 has been formed in accordance with the present invention, a tab 26 is disposed over the rivet 50 as described above. The rivet 50 is staked by moving a punch 82, shown in FIG. 7, against the end wall 30 which is supported in the opposite direction by an outwardly projecting anvil 84 provided on a bottom die 86. It is important that the bottom die 86 be relieved or provided with a recess 88 so as not to affect substantially, or to interfere substantially, with the material defining the annular groove 80 formed about the rivet 50. However, a portion of the end wall 30 of the rivet 50 must be formed into an annular bead 32 disposed in permanent overlapping engagement with a portion of the underlying tab 26. To accomplish such bending, as well as absorb axial compression of the rivet, there is, preferably, provided a support against the force of the punch 82, adjacent the base of the rivet along the general plane of the tear strip 20. Such supporting surface 90 preferably has an outside diameter corresponding to the outside diameter of the bead 32 on the staked rivet 24. Although the staking operation may slightly deform the inner area of the annular ring 80, such deformation is not detrimental since the ring 80 is retained below the plane of the tear strip 20, and no excess metal is forced into the tear strip 20.

What is believed to be the best mode of this invention has been described above. It will be apparent to those skilled in the art that numerous variations of the illustrated details may be made without departing from this invention.

We claim:

1. In a method of forming an integral hollow rivet in deformable sheet material for attaching a tab thereto, comprising the steps of forming a portion of the sheet material into a bubble disposed outwardly of the general plane of sheet;

deforming the bubble portion into a hollow rivet having a generally cylindrical peripheral wall and a generally circular end wall;

positioning a tab on the deformable sheet with the rivet extending through and nesting in an aperture provided in the tab; and deforming the end wall of the rivet toward the general plane of the deformable sheet material to shape a portion of the end wall of the rivet into a bead disposed in permanent overlapping engagement with a portion of the underlying tab;

the improvement comprising during deformation of the bubble portion into a hollow rivet, forming a generally circular portion of the sheet material within the area of the bubble portion, into an annular groove below the general plane of the sheet material; and retaining such annular groove by providing that the material defining the annular groove is substantially unaffected during deformation of the end wall of the rivet to shape a portion of the end wall into a bead disposed in permanent overlapping engagement with the underlying tab.

2. In a method of forming an integral hollow rivet for securing an easy opening tab to an aluminum can end having internal and external surfaces with respect to the interior and exterior of the container to which the can end is secured, comprising the steps of forming a portion of the aluminum into a bubble disposed externally of the general plane of the can end;

deforming the bubble portion into a hollow rivet having a generally cylindrical peripheral wall and a generally circular end wall;

disposing an easy opening tab onto the external surface of the can end with the hollow rivet extending through and nesting in an aperture provided in the tab; and deforming the end wall of the rivet toward the general plane of the can end, such that a portion of the end wall is shaped into a bead disposed in permanent overlapping engagement with a portion of the underlying tab;

the improvement comprising during deformation of the bubble portion into a hollow rivet, forming a generally circular portion of the aluminum, located within the area of the bubble portion, at the base of the rivet, inwardly of the general plane of the can end;

retaining the inwardly formed portion by providing that the aluminum defining the inwardly formed portion is substantially unaffected during deformation of the end wall into the bead disposed in permanent overlapping engagement with the underlying tab.

3. The method of claim 2 wherein the aluminum can end has a gauge less than 0.012 inch.

4. The method of claim 2 wherein the aluminum can end has a gauge of approximately 0.010 inch.

5. The method of claim 2 wherein peripheral support is provided adjacent the base of the rivet against the internal surface of the can end along the general plane of the can end as the end wall of the rivet is deformed into the bead disposed in permanent overlapping engagement with the underlying tab.

6. The method of claim 5 wherein the diameter of the peripheral support is less than or equal to the outside diameter of the bead.

7. A method of forming an integral hollow rivet for securing an easy opening tab to an aluminum can end having internal and external surfaces with respect to the interior and exterior of the container to which the can end is secured, comprising the steps of forming a portion of the aluminum into a bubble disposed externally of the general plane of the can end;

deforming the bubble into a hollow rivet having a generally cylindrical peripheral wall and a generally circular end wall, while substantially simultaneously forming a circular portion of the aluminum located within the area of the bubble portion inwardly of the general plane of the can end into an annular groove around the base of the rivet;

disposing an easy opening tab onto the external surface of the can end with the hollow rivet extending through and nesting in an aperture provided in the tab; and deforming the end wall of the rivet toward the general plane of the can end, while retaining the annular groove by providing that the aluminum defining the annular groove is substantially unaffected as a portion of the end wall is shaped into a bead disposed in permanent overlapping engagement with a portion of the underlying tab.

* * * * *